US008636853B2

(12) United States Patent
Shoji et al.

(10) Patent No.: US 8,636,853 B2
(45) Date of Patent: Jan. 28, 2014

(54) MG ALLOY AND METHOD OF PRODUCTION OF SAME

(75) Inventors: Tetsuya Shoji, Susono (JP); Akira Kato, Mishima (JP); Toshiji Mukai, Tsukuba (JP); Hidetoshi Somekawa, Tsukuba (JP)

(73) Assignees: Toyota Jidosha Kabushiki Kaisha, Toyota-shi, Aichi (JP); National Institute for Materials Science, Tsukuba-shi, Ibaraki (JP)

( * ) Notice: Subject to any disclaimer, the term of this patent is extended or adjusted under 35 U.S.C. 154(b) by 324 days.

(21) Appl. No.: 12/532,856

(22) PCT Filed: Mar. 26, 2008

(86) PCT No.: PCT/JP2008/056536

§ 371 (c)(1),
(2), (4) Date: Mar. 18, 2010

(87) PCT Pub. No.: WO2008/117890

PCT Pub. Date: Oct. 2, 2008

(65) Prior Publication Data

US 2010/0163141 A1 Jul. 1, 2010

(30) Foreign Application Priority Data

Mar. 26, 2007 (JP) ..... 2007-080224

(51) Int. Cl.
*C22C 23/06* (2006.01)

(52) U.S. Cl.
USPC ..... 148/420; 148/406; 148/666; 148/667; 420/402

(58) Field of Classification Search
USPC ..... 148/406, 420, 666, 667; 420/402, 416
See application file for complete search history.

(56) References Cited

U.S. PATENT DOCUMENTS 3,391,034 A 7/1968 London et al.
2002/0197181 A1 12/2002 Osawa et al.

(Continued)

FOREIGN PATENT DOCUMENTS

EP 1 688 509 8/2006
JP 5-306424 11/1993

(Continued)

OTHER PUBLICATIONS

Suzuki et al. "Creep behavior and deformation microstructures of Mg—Y alloys at 550 K." Materials Science and Engineering A252, pp. 248-255. 1998.*

(Continued)

*Primary Examiner* — Brian Walck
(74) *Attorney, Agent, or Firm* — Finnegan, Henderson, Farabow, Garrett & Dunner, LLP

(57) ABSTRACT

An Mg alloy provided with high strength and high ductility by matching the strength and ductility in tensile deformation and compressive deformation at the same levels is provided. The Mg alloy of the present invention is characterized by having a chemical composition consisting of Y: 0.1 to 1.5 at % and a balance of Mg and unavoidable impurities and having a microstructure with high Y regions with Y concentrations higher than an average Y concentration distributed at nanometer order sizes and intervals. The present invention further provides an Mg alloy characterized by having a chemical composition consisting of Y: more than 0.1 at % and a valance of Mg and unavoidable impurities, having a microstructure with high Y regions with Y concentrations higher than an average Y concentration distributed at nanometer order sizes and intervals and having an average recrystallized grain size within the range satisfying the following formula 1:

$$-0.87c+1.10<\log d<1.14c+1.48, \quad \text{formula 1:}$$

where c: Y content (at %) and
d: average recrystallized grain size (μm).

7 Claims, 6 Drawing Sheets

(56) References Cited

U.S. PATENT DOCUMENTS

| | | | | |
|---|---|---|---|---|
| 2005/0279427 | A1 | 12/2005 | Park et al. | |
| 2008/0017285 | A1 * | 1/2008 | Mukai et al. | 148/667 |

FOREIGN PATENT DOCUMENTS

| | | | |
|---|---|---|---|
| JP | 7-3375 | | 1/1995 |
| JP | 9-125172 | | 5/1997 |
| JP | 2002-256370 | | 9/2002 |
| JP | 2005-113235 | | 4/2005 |
| JP | 2006-2184 | | 1/2006 |
| JP | 2006-16658 | | 1/2006 |
| WO | WO 2004/085689 | A1 | 10/2004 |

OTHER PUBLICATIONS

M. Nishijima et al., "Characterization of β' Precipitate Phase in Mg-2 at %Y Alloy Aged to Peak Hardness Condition by High-Angle Annular Detector Dark-Field Scanning Transmission Electron Microscopy (HAADF-STEM)," Materials Transactions, vol. 48, No. 1, pp. 84-87 (2007).

S. Agnew et al., "Mg Sheet Metal Forming: Lessons Learned from Deep Drawing Li and Y Solid-Solution Alloys," JOM, pp. 62-69 (May 2006).

T. Mukai et al., "Magnesium no Shitsuon Henkei Oto ni Oyobosu Biryo Yoshitsu Genso Tenka no Eikyo," Abstracts of the Japan Institute of Metals 2006 Nen Shunki (Dai 138 Kai) Taikai, p. 126 (Mar. 21, 2006).

H. Somekawa et al., "Yttrium Bunsan ni yoru Magnesium Tenshinzai no Henkei Ihosei Teigen," Abstracts of the Japan Institute of Metals 2007 Nen Shunki (Dai 140 Kai ) Taikai, p. 451 (Mar. 27, 2007).

Extended European Search Report for EP Appl. No. 08739647.9 dated Dec. 12, 2011.

* cited by examiner (10x10.5x60 nm$^3$)

TO: TENSILE DEFORMATION OF EXTRUDED MATERIAL
CO: COMPRESSIVE DEFORMATION OF EXTRUDED MATERIAL
TH: TENSILE DEFORMATION OF EXTRUDED AND HEAT-TREATED MATERIAL
CH: COMPRESSIVE DEFORMATION OF EXTRUDED AND HEAT-TREATED MATERIAL

REGION (1) : (YIELD STRESS RATIO (B/A)) > 0.84

$$\begin{cases} c > 0.1 \\ \log(d) > -0.87(c) + 1.10 \\ \log(d) < 1.14(c) + 1.48 \end{cases}$$

REGION (2) : (YIELD STRESS RATIO (B/A)) > 0.93

$$\begin{cases} c > 0.6 \\ \log(d) > -0.55(c) + 1.20 \\ \log(d) < 1.13(c) + 0.93 \end{cases}$$

REGION (1) : (COMPRESSIVE BREAKAGE STRAIN) > 0.20

$$\log(d) > -0.31(c) + 0.92$$

REGION (2) : (COMPRESSIVE BREAKAGE STRAIN) > 0.35

$$\begin{cases} \log(d) > -0.31(c) + 1.22 \\ \log(d) < -2.60(c) + 6.14 \end{cases}$$

MG ALLOY AND METHOD OF PRODUCTION OF SAME

CROSS-REFERENCE TO RELATED APPLICATIONS

This application is a national phase application of International Application No. PCT/JP2008/056536, filed Mar. 26, 2008, and claims the priority of Japanese Application No. 2007-080224, filed Mar. 26, 2007, the contents of both of which are incorporated herein by reference.

TECHNICAL FIELD

The present invention relates to an Mg alloy and a method of production thereof, more particularly relates to an Mg alloy improved in isotropy of deformation, and a method of production thereof.

BACKGROUND ART

An Mg alloy is light weight, gives strength at room temperature and high temperature, and is improved in corrosion resistance as well, so is being increasingly used for various applications. However, to improve the toughness as a structure and the plastic workability, the ductility has to be improved.

For example, Japanese Patent Publication (A) No. 2002-256370 proposes $Mg_{100-a-b}Ln_aM_b$, where Ln is at least one of Y, La, Ce, Pr, Nd, Pm, Sm, Eu, Gd, Tb, Dy, Ho, Er, Tm, Tb, Lu, and a misch metal, M is at least one of Al and Zn, $0.5 \leq a \leq 5$, $0.2 \leq b \leq 4$, and $1.5 \leq a+b \leq 7$, where the crystal grain size is less than 2000 nm (=2 μm) so as to obtain high strength and high ductility. However, with a Zn content larger than 1 at %, the solid solubility limit in the Mg is exceeded, so Mg—Zn-based intermetallic compounds are produced and a high ductility is liable not to be realizable.

Further, Japanese Patent Publication (A) No. 5-306929 proposes $Mg_{ba1}X_aLn_b$, where X is at least one of Zn, Ni, and Cu, Ln is at least one of Y, La, Ce, and a misch metal, $1 \leq a \leq 10$, and $1 \leq b \leq 20$, where the average size of the crystal grains is 5 μm or less and the average grain size of the intermetallic compounds is 5 μm or less to provide strength, toughness, and secondary workability.

Japanese Patent Publication (A) No. 7-3375 proposes $Mg_aZn_bX_c$, where X is at least one element of Y, Ce, La, Nd, Pr, Sm, and a misch metal, 87 at % $\leq a \leq$ 98 at %, b and c are in the ranges shown in FIG. 1, $0 \leq Y \leq 4.5$ at %, 0≤Ce, La, Nd, Pr, Sm, misch metal≤3 at %, where the microstructure is composed of a matrix phase of fine crystals in which Mg—Zn-based and Mg—X-based intermetallic compounds are dispersed so as to obtain high strength and high toughness.

International Patent Publication WO2004/085689 proposes including Zn in an amount of a at %, including at least one rare earth element selected from the group of La, Ce, and misch metals in a total of b at %, having a balance of Mg, with a and b satisfying the following expressions (1) to (3): (1) $0.2 \leq a \leq 3.0$, (2) $0.3 \leq b \leq 1.8$, and (3) $-0.2a+0.55 \leq b \leq -0.2a+1.95$ so as to obtain a high strength and high toughness.

Japanese Patent Publication (A) No. 2005-113235 proposes $Mg_{100-a-b}Zn_aY_b$, where $a/12 \leq b \leq a/3$ and $1.5 \leq a \leq 10$, where the microstructure is an aged precipitated phase of Mg3Zn6Y1 quasi-crystals and their similar crystals dispersed in the state of microparticles so as to improve the high temperature strength.

Japanese Patent Publication (A) No. 2006-2184 proposes an Mg-based alloy containing 1 to 8 wt % of rare earth elements and 1 to 6 wt % of Ca and having a microstructure in which the maximum crystal grain size of Mg is 30 μm or less, the maximum grain size of intermetallic compounds is 20 μm or less, and the Mg is dispersed in the crystal grains and at the crystal grain boundaries so as to improve the strength and ductility at room temperature and the high temperature strength and fatigue strength near 200° C.

However, in each of the above, the difference in strength between the tensile deformation and the compressive deformation and ductility was not considered at all.

DISCLOSURE OF THE INVENTION

The present invention has as its object the provision of an Mg alloy provided with both high strength and high ductility by making the strength and ductility in tensile deformation and compressive deformation equal levels and a method of production of the same.

To achieve the above object, according to the first aspect, the Mg alloy of the present invention is characterized by having a chemical composition consisting of Y: 0.1 to 1.5 at % and a balance of Mg and unavoidable impurities and having a microstructure with high Y regions with Y concentrations higher than an average concentration distributed at nanometer order sizes and intervals.

The method of production of the Mg alloy of the present invention is characterized by forming the above microstructure by but working an alloy having the above chemical composition, then isothermally heat treating it.

The Mg alloy of the present invention can be deformed in directions other than along the bottom face of the Mg hexagonal crystal due to the above prescribed chemical composition and microstructure and can realize high ductility due to the match of the yield strengths in tensile deformation and compressive deformation.

The method of the present invention can produce the above Mg alloy of the present invention by hot working and isothermally heat treating an Mg alloy of the above chemical composition to form the above microstructure.

According to the second aspect, the Mg alloy of the present invention is characterized by having a chemical composition consisting of Y: more than 0.1 at % and a balance of Mg and unavoidable impurities, having a microstructure with high Y regions with Y concentrations higher than an average Y concentration distributed at nanometer order sizes and intervals and having an average recrystallized grain size within the range satisfying the following formula 1:

$$-0.87c+1.10<\log d<1.14c+1.48 \quad \text{formula 1:}$$

where c: Y content (at %) and d: average grain diameter (μm).

Preferably, according to the second aspect, the Mg alloy has a Y content of more than 0.6 at % and an average recrystallized grain size within the range satisfying the following formula 2:

$$-0.55c+15.9<\log d<1.13c+0.93. \quad \text{formula 2:}$$

More preferably, according to the second aspect, the Mg alloy has an average recrystallized grain size within the range satisfying the following formula 3:

$$\log d>-0.31c+0.92. \quad \text{formula 3:}$$

Most preferably, the Mg alloy has an average recrystallized grain size within the range satisfying the following formula 4:

$$-0.31c+1.22<\log d<-2.60c+6.14. \quad \text{formula 4:}$$

BEST MODE FOR CARRYING OUT THE INVENTION

Figure 1:
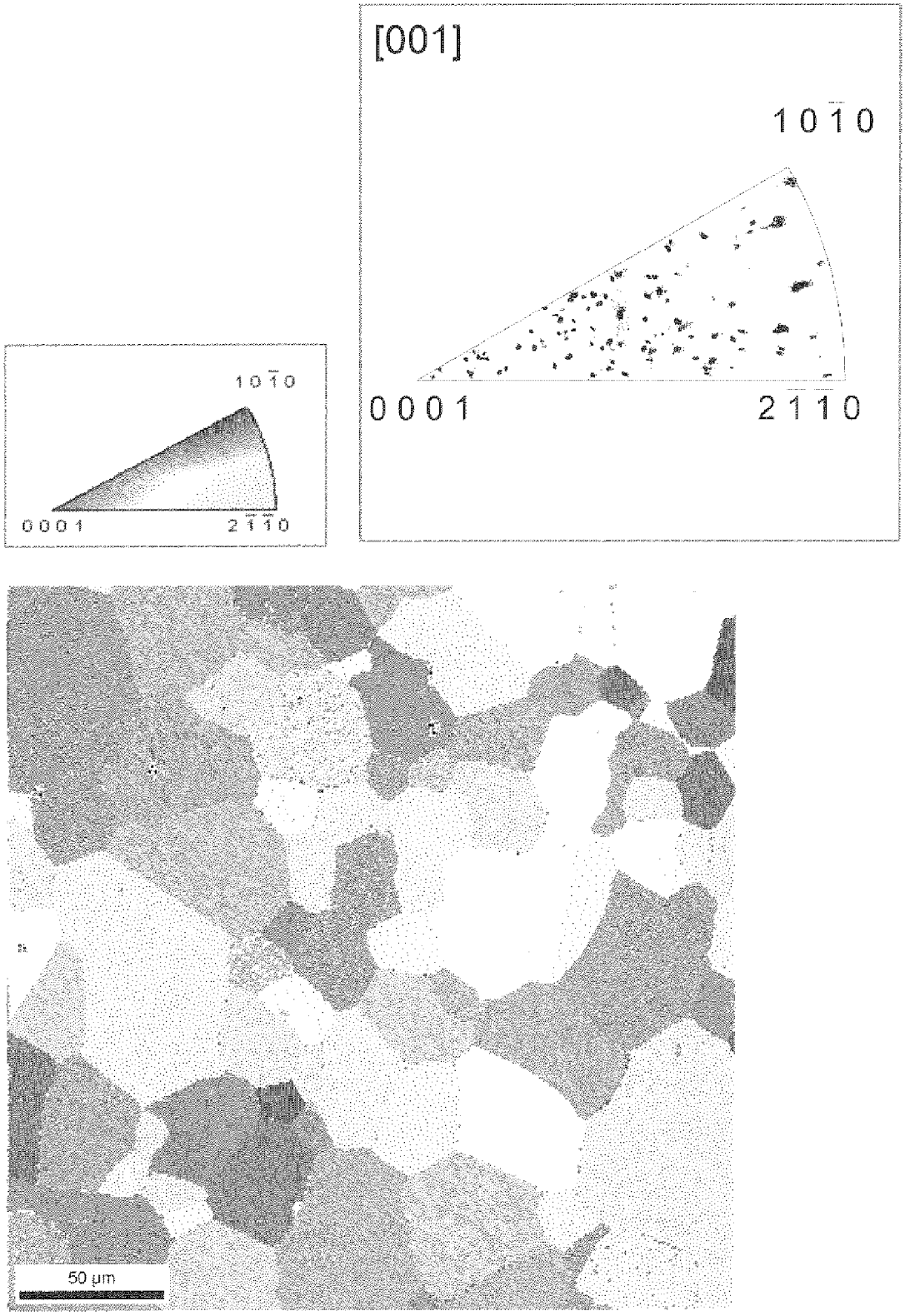
FIG. 1 shows the results of analysis of an Mg-0.6 at % alloy of the present invention by a scanning electron microscope (SEM) and electron back scatter diffraction (EBSD) of the cross-section parallel to the direction of extrusion of an extruded and heat treated material.

The inventors newly discovered that in the first aspect of the present invention, by adding 0.1 to 1.5 at % of Y to Mg and hot working and isothermally heat treating it to form a microstructure with high Y regions with Y concentrations higher than an average concentration dispersed at nanometer order sizes and intervals, it is possible to match the yield strengths in tensile deformation and compressive deformation and possible to achieve high deformation isotropy and thereby completed the present invention.

In the method of the present invention, the temperature and amount of strain of the hot working and the temperature of the heat treatment do not particularly have to be limited so long as they are temperatures giving the above microstructures as a result. In general, the hot working temperature is preferably 300° C. or more so as to form uniform fine recrystallized grains over the entire material, but to build up strain along with working, it is preferably 450° C. or less. The amount of strain of the hot working is preferably an equivalent plastic strain of 3 or more so as to make the initial structure uniformly finer. The temperature of the heat treatment is preferably the hot working temperature or more so as to grow equiaxed crystal grains, but to form regions with different Y concentrations, the temperature is preferably 450° C. or less.

In a conventional wrought Mg alloy such as AZ31, the plastic deformation near normal temperature is performed by slip deformation due to the motion of dislocations in the close packed crystal plane, that is, the so-called basal plane of an Mg hexagonal crystal. If slip deformation other than the direction along the basal plane is hard to occur in this way, in particular in compressive deformation, deformation by twinning easily occurs. That is, in compressive deformation, deformation by twinning occurs with priority over slip deformation due to dislocations. Specifically, in a stress-strain diagram, the phenomenon occurs where the yield strength and the work hardening rate after yielding fall in compressive deformation compared with tensile deformation.

If the deformation behavior differs between tensile deformation and compressive deformation in this way, that is, so-called deformation anisotropy occurs, when an external force acts on a 3D structure made of the Mg alloy, twinning deformation will occur at the locations acted on by the compressive stress, so deformation will start by a lower stress than the locations acted on by tensile stress and, further, the work hardening rate will be small, deformation twinning occurs forming fracture origins at a low stress and small strain and deformation concentrates at part of the deformation twinning, so the stress rapidly increases, then fracture occurs at a small strain.

Therefore, in the past, the strength characteristics of an Mg alloy in the final analysis ended up having a deformation degree limited by the deformation characteristics in compression.

In the Mg alloy of the present invention, to achieve the deformation behavior in tensile deformation and compressive deformation, in particular matched yield strengths and isotropy of deformation, a chemical composition consisting of Y: 0.1 to 1.5 at % and a balance of Mg and unavoidable impurities and a microstructure where high Y regions with Y concentrations higher than an average concentration are dispersed at nanometer order sizes and intervals are prescribed.

In the present invention, as indicators of the isotropy of deformation, the two characteristic values of the following (1) and (2) are used. When these simultaneously satisfy their prescribed conditions, the deformation isotropy is judged good.

1) Yield Stress Ratio≥0.6

The ratio between the yield stress in compressive deformation and the yield stress in tensile deformation, that is, the "yield stress ratio", is used. The value should be 0.6 or more.

2) Nominal Compressive Strain≥0.4

As an indicator of ductility in compressive deformation, the "nominal compressive strain" is used. The value should be 0.4 or more.

To simultaneously satisfy these conditions, the Y content must be within the range of 0.1 to 1.5 at %.

Below, specific examples will be used to explain in further detail the present invention including the mechanism of achieving deformation isotropy.

Example I

Examples of the first aspect of the present invention will be described.

<Preparation of Alloy>

Yttrium (Y) and pure magnesium (Mg) (purity 99.95 wt %) were completely melted in an argon atmosphere and cast into iron molds to prepare seven Mg—Y alloys with Y contents of 0.1 at %, 0.3 at %, 0.6 at %, 1.0 at %, 1.2 at %, 1.5 at %, and 2.2 at %. The Y contents 0.1 at % to 1.5 at % are invention examples in the range of the present invention, while the Y content 2.2 at % is a comparative example outside the range of the present invention, which are shown in Table 1 as Examples 1 to 6 and Comparative Example 1. Note that Table 1 also shows alloys with Al, Zn, and Li as elements other than Y as Comparative Examples 2 to 6. The alloys of Comparative Examples 1 to 6 were also prepared by the procedure and conditions shown below in the same way as the alloys of Examples 1 to 6.

TABLE 1

| Class | | Alloy (at %) | Extrusion temperature (° C.) | Tensile yield Stress (A) (MPa) | Compressive yield stress (B) (MPa) | Yield stress ratio (B/A) | Compressive breakage strain |
|---|---|---|---|---|---|---|---|
| Inv. | 1 | Mg—0.1Y | 310 | 85 | 56 | 0.66 | 0.46 |
| ex. | 2 | Mg—0.3Y | 310 | 92 | 60 | 0.65 | 0.48 |
| | 3 | Mg—0.6Y | 425 | 81 | 72 | 0.86 | >0.50 |
| | 4 | Mg—1.0Y | 320 | 99 | 93 | 0.94 | >0.50 |
| | 5 | Mg—1.2Y | 340 | 93 | 94 | 1.01 | >0.50 |
| | 6 | Mg—1.5Y | 360 | 108 | 115 | 1.06 | 0.46 |
| Comp. | 1 | Mg—2.2Y | 425 | — | 172 | — | 0.33 |
| ex. | 2 | Mg—0.6Al | 170 | 68 | 27 | 0.40 | 0.25 |
| | 3 | Mg—1.9Al | 200 | 130 | 74 | 0.57 | 0.32 |
| | 4 | Mg—0.3Zn | 170 | 140 | 52 | 0.37 | 0.21 |
| | 5 | Mg—1.0Zn | 185 | 140 | 60 | 0.43 | 0.28 |
| | 6 | Mg—1.0Li | 115 | 130 | 47 | 0.36 | 0.22 |

The obtained cast alloys were held in a furnace at a temperature of 500° C. for 24 hours in the atmosphere, then water cooled to solution treat them.

After this, the alloys were machined to prepare cylindrical materials having a diameter of 40 mm and a length of 70 mm.

These cylindrical materials were held in containers held at the extrusion temperatures shown in Table 1 (in the atmosphere) for 30 minutes, then extruded by an extrusion ratio of 25:1 in severe hot working. The average equivalent plastic strain determined from the rate of reduction of cross-section was 3.7.

The extruded materials were isothermally held in a furnace at 400° C. for 24 hours, then air cooled outside the furnace.

<Observation of Microstructure>

FIG. 1 shows a scanning electron microscope (SEM) photograph of the cross-section parallel to the extrusion direction of the obtained extruded and heat treated material for the Mg-0.6 at % alloy of Example 3 as a representative example of the present invention. As illustrated, the crystal grain structure was an equiaxed grain structure free of flow structures caused by working. Further, electron back scatter diffraction (EBSD) was used for analysis. As a result, no texture was observed and the individual crystal grains had random orientations. From these results, it is learned that the structure has a high isotropy with the crystal grain size of the order of several μm to tens of μm. The above structure was similarly obtained in the other examples.

If the conventional typical wrought Mg alloy AZ31 is rolled, forged, extruded, or otherwise hot worked, it strongly tends to form a texture with the close packed crystal plane of the crystal lattice (basal plane of hexagonal crystal) oriented parallel to the working direction and aggravates the anisotropy of deformation. As opposed to this, in the alloy of the present invention, even in the state as hot extruded as above, the crystal grain structure becomes an equiaxed grain structure, no texture due to working is observed, and a structure advantageous for achieving isotropy of deformation is obtained. Note that in this example, the hot working was performed by extrusion, but rolling, forging, or other hot working methods may also be used.

Figure 2:
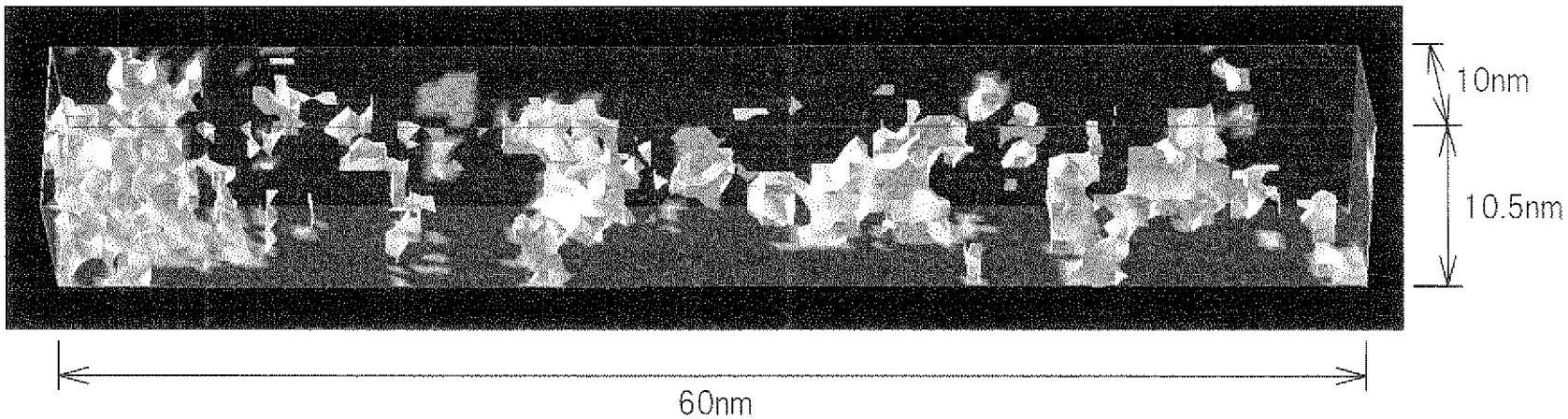
FIG. 2 shows the results of atom probe observation of an Mg-0.6 at % alloy of the present invention.

Furthermore, the results of atom probe observation of an Mg-0.6 at % alloy are shown in FIG. 2. In the figure, the bright gray colored (substantially white colored) spots are high Y regions having Y concentrations of 1.0 at % or more—which is higher than the average concentration of 0.6 at %. It is confirmed that high Y regions of a size of the order of several nm are distributed at intervals of several nm. Note that FIG. 2 shows the case of 1.0 at % or more high Y regions for the Mg-0.6 at % alloy of Example 3 as a typical example of observation, but in each of the other examples as well, high Y regions higher than the average concentration by 50% or so or more and conversely low Y regions lower than the average concentration by 50% or so were observed to be alternately distributed by several nm order sizes and intervals.

Further, by further detailed observation, it was learned that in each example, such nanometer order high Y regions are uniformly distributed in the crystal grains, but the density of distribution is also high at the crystal grain boundaries.

<Static Tensile Test and Static Compression Test>

For the prepared Mg alloys of Examples 1 to 6 and Comparative Examples 1 to 6, test pieces taken from the above extruded and heat treated materials were subjected to a static tensile test and compressive test at room temperature at a strain rate of $1\times10^{-3}$/sec.

Figure 3:
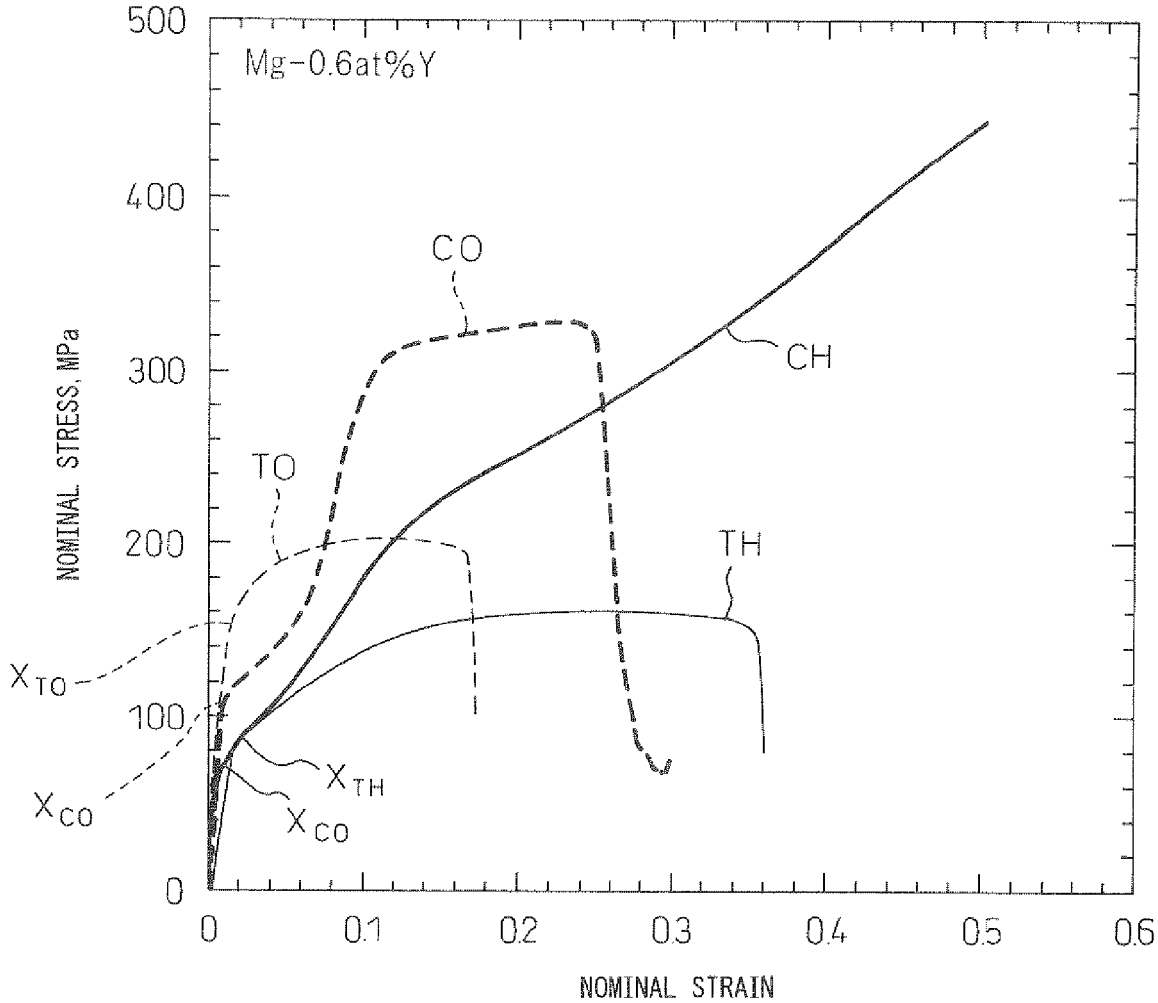
FIG. 3 shows a nominal stress-nominal strain diagram in a tensile test and compression test of a hot worked material and a hot extruded and heat treated material for an Mg-0.6 at % alloy of the present invention.
Figure 4:
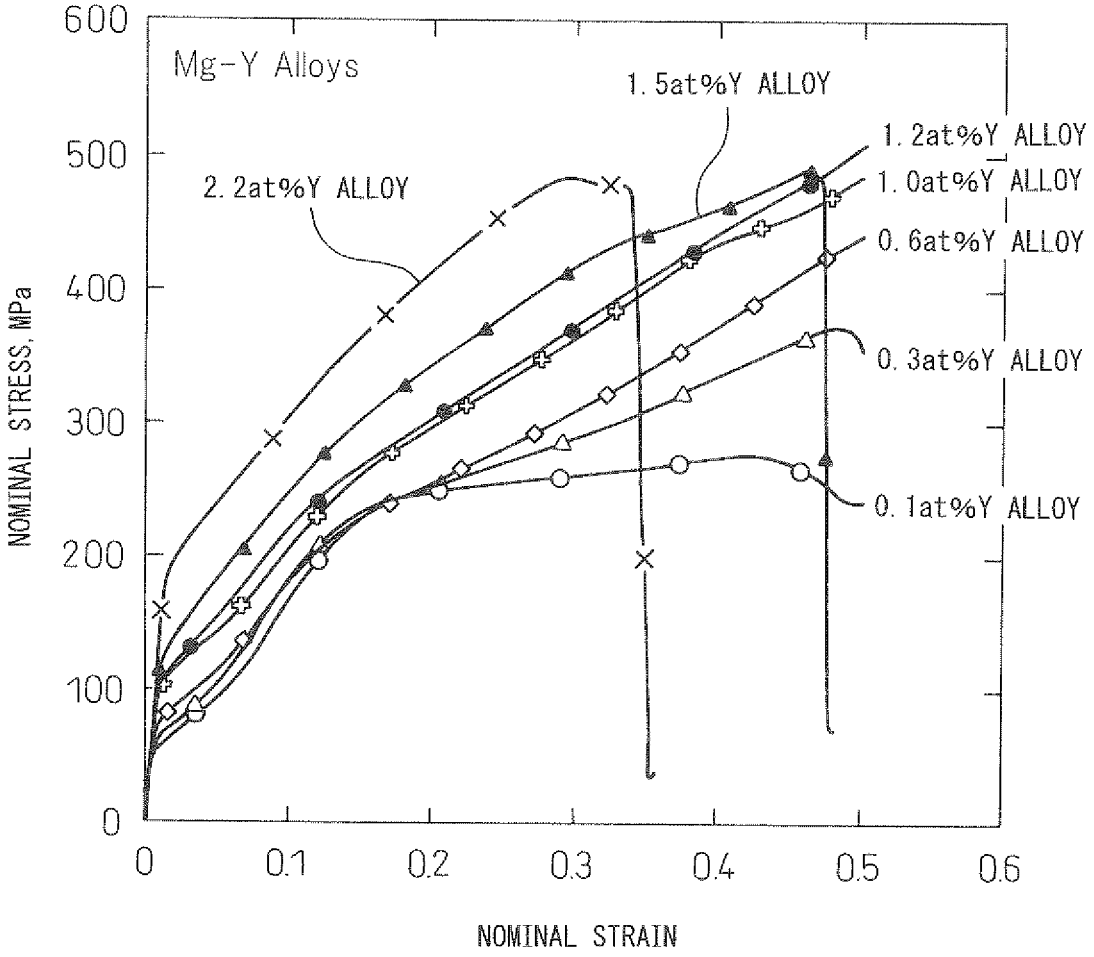
FIG. 4 shows a nominal stress-nominal strain diagram in a compression test of a hot extruded and heat treated material for an Mg-alloy of the present invention and a comparative alloy.

FIG. 3 shows the nominal stress-nominal strain diagram in the above tensile test and compression test of the Mg-0.6 at % Y alloy of Example 3 as a typical example of the present invention. In the as extruded state, there is a large difference between the yield stresses $X_{T0}$ and $X_{C0}$ of the tensile deformation T0 and compressive deformation C0, but in the extruded, then heat treated state, the difference between the yield stresses $X_{TH}$ and $X_{CH}$ of the tensile deformation TH and the compressive deformation CH is remarkably reduced and the deformation anisotropy is greatly lightened. Further, FIG. 4 shows the nominal stress-nominal strain diagrams for only the compression tests for Examples 1 to 6 and Comparative Example 1. The results of both the tension and compression tests are shown together in Table 1.

From the results of Table 1, Examples 1 to 6 where the Y content is in the range of 0.1 at to 1.5 at % have yield stress ratios (=compressive yield stress/tensile yield stress) of 0.6 or more, have compressive breakage strains of 0.4 or more, and have high isotropy of deformation. Note that in Example 5 and Example 6 of 1.2 at % Y and 1.5 at % Y, a deformation isotropy with a yield stress ratio close to 1.0 is secured.

As opposed to this, in Comparative Example 1 where the Y content is outside the range of the present invention and Comparative Examples 2 to 6 of alloys other than with Y, the yield stress ratio was less than 0.6, the compressive breakage strain was less than 0.4, and the isotropy of deformation was inferior.

<Impact Compression Test>

A test piece was taken from the hot extruded and heat treated material and subjected to an impact compression test at room temperature at a strain rate of $1.3\times10^{3}$/sec. A compressive load was applied until a nominal strain of 27%, but the test piece deformed uniformly without the occurrence of cracks at the side faces.

The high deformation isotropy was believed to have been achieved in the Mg alloy of the present invention as shown in the above examples due to the following mechanism.

The presence of nanometer order high Y regions where the large atom size Y concentrates causes the crystal lattice to be remarkably distorted, so it becomes difficult for the dislocations to pass through the high Y regions when moving through the basal plane of the hexagonal crystal. As a result, slip no longer occurs preferentially at the basal plane and the slip system at the crystal planes other than the basal plane becomes active.

As shown in FIG. 1, the crystal grain size is a coarse one of 10 μm or more, so at the start of deformation (until nominal strain of 15% or so), [10-12] twinning is easily formed in the crystal grains and brings out the deformation ability at the start of deformation. As opposed to this, the freedom of deformation increases in the above way, so cross slip of the dislocations easily occurs in the crystal grains in the middle of the deformation, sub-crystal grain boundaries are formed from the interaction of the dislocations, and the grain boundary angles increase, so localization of dislocations is suppressed and the remarkable work hardening seen in conventional wrought Mg alloys is suppressed.

The reason why anisotropy of deformation due to compressive deformation and tensile deformation occurred was the occurrence of twinning due to compressive deformation. Therefore, in the alloy of the present invention where the occurrence of twinning is reduced at the time of start of deformation due to the increase in the slip deformation, the difference in deformation behavior in tension and compression is greatly reduced or completely eliminated and the isotropy of the yield stress remarkably rises.

Furthermore, the lattice strain due to the distribution of nanometer order high Y regions preventing the occurrence of twinning in the above way simultaneously functions as resistance to motion of the dislocations responsible for slip deformation, so act extremely effectively as an alloy strengthening mechanism. The strengthening mechanism in action here is not just strengthening in the grains due to lattice strain in the crystal grains. It also effectively acts for strengthening of the crystal grain boundaries at which the high Y regions are distributed at a higher density than in the grains and contributes to improvement of the ductility of the alloy due to the prevention of intergranular fracture. Of course, grain boundary strengthening is also effective for improving the creep strength at high temperatures.

Example II

Examples of the second aspect of the present invention will be described.

Mg—Y alloys having the chemical compositions shown in Table 2 were prepared in the same procedure and conditions as in Example I. The extrusion temperatures shown in Table 2 were used. Average recrystallized grain size (μm), tensile yield stress (A), compressive yield stress (B), yield stress ratio (B/A), and compressive breakage strain were measured in the same way as in Example I. The results are summarized in Table 2.

TABLE 2

| Sample No. | Alloy (at. %) | ET (° C.) | ARGS (μm) | TYS (A) (MPa) | CYS (B) (MPa) | YSR (B/A) | CBS |
|---|---|---|---|---|---|---|---|
| 1 | Mg—0.1 Y | 310 | 1.7 | 278 | 140 | 0.5 | 0.14 |
| 2 | Mg—0.1 Y | 310 | 3.5 | 284 | 148 | 0.52 | 0.14 |

TABLE 2-continued

| Sample No. | Alloy (at. %) | ET (° C.) | ARGS (μm) | TYS (A) (MPa) | CYS (B) (MPa) | YSR (B/A) | CBS |
|---|---|---|---|---|---|---|---|
| 3 | Mg—0.1 Y | 310 | 15.5 | 169 | 113 | 0.67 | 0.25 |
| 4 | Mg—0.1 Y | 310 | 80 | 87 | 56 | 0.64 | 0.49 |
| 5 | Mg—0.1 Y | 310 | 277 | 40 | 33 | 0.83 | 0.43 |
| 6 | Mg—0.3 Y | 310 | 1.7 | 310 | 199 | 0.64 | |
| 7 | Mg—0.3 Y | 310 | | 317 | 199 | 0.63 | 0.12 |
| 8 | Mg—0.3 Y | 310 | 7 | 181 | 144 | 0.8 | 0.2 |
| 9 | Mg—0.3 Y | 310 | 50 | 88.2 | 59 | 0.67 | 0.5 |
| 10 | Mg—0.3 Y | 310 | 264 | 53 | 44 | 0.83 | 0.5 |
| 11 | Mg—0.6 Y | 320 | 1.4 | 337 | 250 | 0.74 | 0.13 |
| 12 | Mg—0.6 Y | 320 | 12.7 | 157 | 109 | 0.69 | 0.5 |
| 13 | Mg—0.6 Y | 425 | 44 | 86 | 77 | 0.9 | 0.51 |
| 14 | Mg—0.67 Y | 320 | 1.7 | 290 | 227 | 0.78 | 0.15 |
| 15 | Mg—0.67 Y | 320 | 3.5 | 273 | 235 | 0.86 | 0.14 |
| 16 | Mg—0.67 Y | 320 | 7 | 185 | 175 | 0.95 | 0.27 |
| 17 | Mg—0.67 Y | 320 | 17 | 97 | 95 | 0.98 | 0.5 |
| 18 | Mg—0.67 Y | 320 | 49 | 89 | 76 | 0.85 | 0.5 |
| 19 | Mg—0.67 Y | 320 | 174 | 64 | 52 | 0.81 | 0.48 |
| 20 | Mg—1.2 Y | 340 | 3.5 | 261 | 232 | 0.89 | 0.15 |
| 21 | Mg—1.2 Y | 340 | 17 | 119 | 115 | 0.97 | 0.51 |
| 22 | Mg—1.2 Y | 340 | 29 | 88 | 87 | 0.99 | 0.5 |
| 23 | Mg—1.2 Y | 340 | 193 | 78 | 70 | 0.9 | 0.41 |
| 24 | Mg—1.5 Y | 360 | 5.8 | 234 | 216 | 0.92 | 0.22 |
| 25 | Mg—1.5 Y | 360 | 5.2 | 216 | 210 | 0.97 | 0.2 |
| 26 | Mg—1.5 Y | 360 | 7 | 137 | 136 | 0.99 | 0.41 |
| 27 | Mg—1.5 Y | 360 | 33 | 100 | 101 | 1.01 | 0.47 |
| 28 | Mg—1.5 Y | 360 | 164 | 94 | 91 | 0.97 | 0.35 |
| 29 | Mg—2.0 Y | 420 | 9.1 | 224 | 217 | 0.97 | 0.27 |
| 30 | Mg—2.0 Y | 420 | 8.7 | 212 | 220 | 1.04 | 0.23 |
| 31 | Mg—2.0 Y | 420 | 13.4 | 162 | 167 | 1.03 | 0.3 |
| 32 | Mg—2.0 Y | 420 | 37 | 152.8 | 144 | 0.94 | 0.37 |
| 33 | Mg—2.0 Y | 420 | 209 | 106 | 100 | 0.94 | 0.29 |
| 34 | Mg—2.2 Y | 425 | 9.5 | 222 | 220 | 0.99 | 0.3 |
| 35 | Mg—2.2 Y | 425 | 240 | 117 | 118 | 1.01 | 0.32 |
| 36 | Mg—3.0 Y | 450 | 9.1 | 250 | 259 | 1.04 | 0.27 |
| 37 | Mg—3.0 Y | 450 | 148 | 156 | 154 | 0.99 | 0.28 |

ET: Extrusion temperature, ARGS: Average recrystallized grain size, TYS: Tensile yield stress, CYS: Compressive yield stress, YSR: Yield stress ratio, CBS: Compressive breakage strain.

Figure 5:
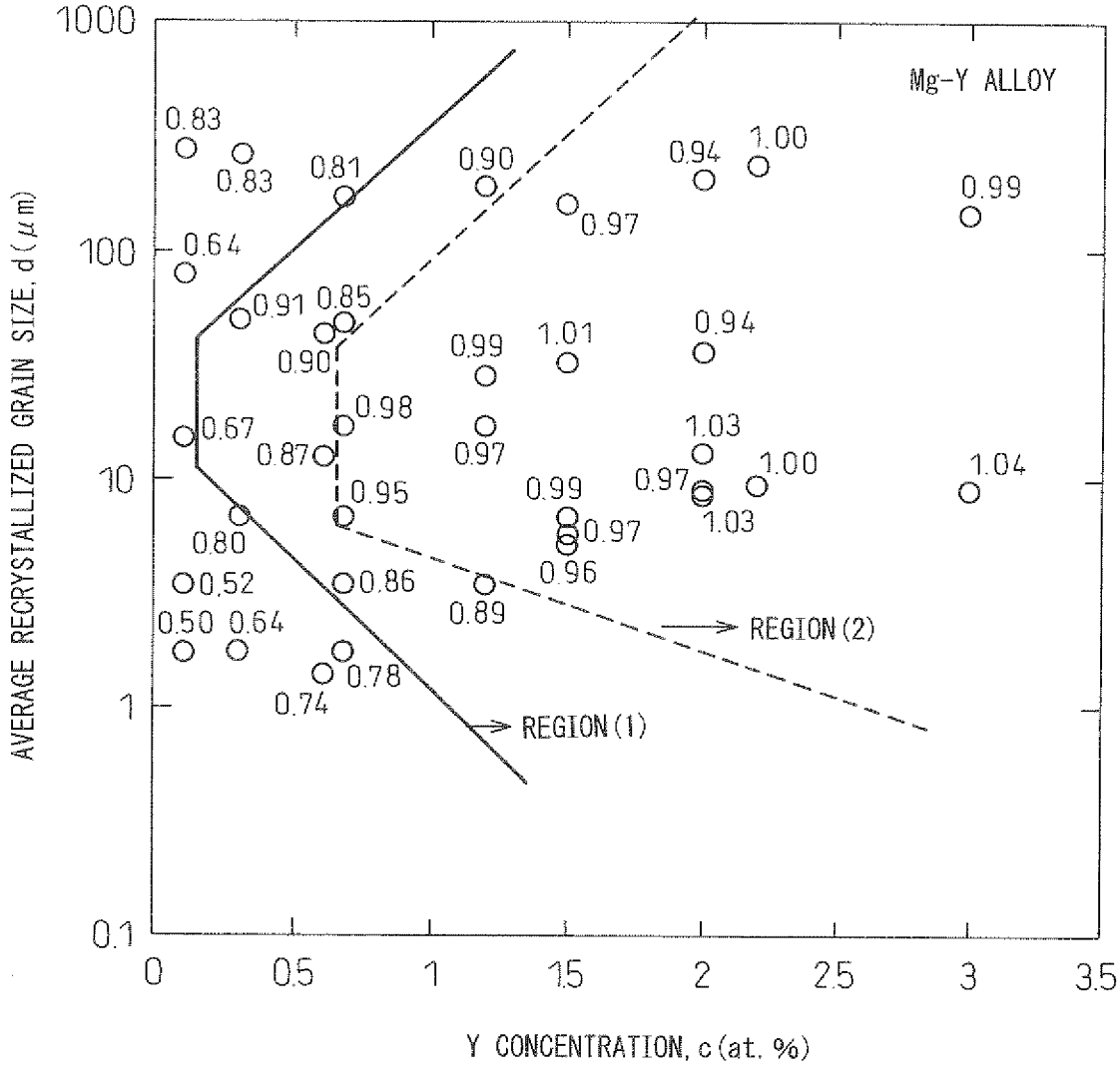
FIG. 5 is a graph showing plots of various combinations of a Y concentration (c) and an average recrystallized grain size (d) with yield stress ratios (B/A) obtained by the combinations for the second aspect of the present invention.
Figure 6:
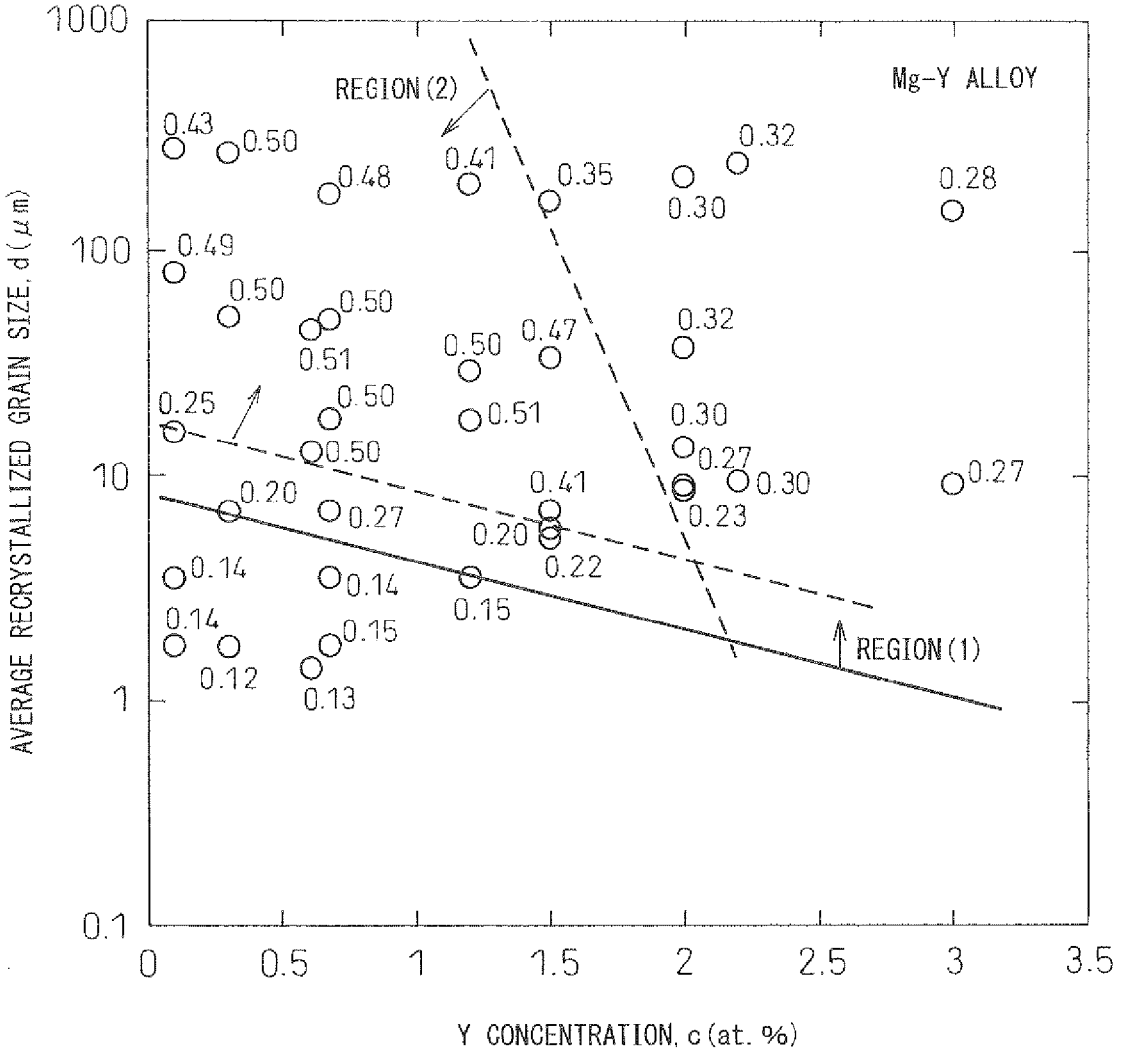
FIG. 6 is a graph showing plots of various combinations of a Y concentration (c) and an average recrystallized grain size (d) with compressive breakage strains obtained by the combinations for the second aspect of the present invention.

In FIGS. 5 and 6, various combinations of a Y concentration (c) and an average recrystallized grain size (d) are plotted and the yield stress ratios and compressive breakage strains obtained thereby are appended to the plots.

In the region (1) of FIG. 5, high yield stress ratios (B/A) of more than 0.84 are achieved and the following formula 1 is satisfied:

$$-0.87c+1.10<\log d<1.14c+1.48, \quad \text{formula 1:}$$

where c: Y content (at %) and d: average recrystallized grain size (μm).

In the region (2) of FIG. 5, yet higher yield stress ratios (B/A) of more than 0.93 are achieved and the following formula 2 is satisfied:

$$-0.55c+1.20<\log d<1.13c+0.93, \quad \text{formula 2:}$$

where c: Y content (at %) and d: average recrystallized grain size (μm).

In the region (1) of FIG. 6, compressive breakage strains of more than 0.20 are achieved and the following formula 3 is satisfied:

$$\log d>-0.31c+0.92, \quad \text{formula 3:}$$

where c: Y content (at %) and d: average recrystallized grain size (μm).

In the region (2) of FIG. 6, compressive breakage strains of more than 0.35 are achieved and the following formula 4 is satisfied:

$$-0.31c+1.22<\log d<-2.60c+6.14, \quad \text{formula 4:}$$

where c: Y content (at %) and d: average recrystallized grain size (μm).

As shown in Example II, an extremely high yield stress ratio and compressive breakage strain can be achieved by appropriate combination of the Y concentration (c) and average recrystallized grain size (d).

INDUSTRIAL APPLICABILITY

According to the present invention, there are provided an Mg alloy provided with a high strength and high ductility due to the strength and ductility at tensile deformation and compressive deformation being matched to equal levels and a method of production of the same.

The Mg alloy of the present invention achieves an increase in the freedom of deformation in the crystal grains and randomization of the crystal orientation distribution. Therefore, the isotropy of deformation which could not be achieved in conventional magnesium alloys, that is, closer yield stresses in compressive and tensile deformations, becomes possible.

Therefore, when an external force acts on a 3D structure formed using a wrought material (plates, bars, or pipes) comprised of the Mg alloy of the present invention, the deformation of the material becomes close to isotropic, whereby equal strength is exhibited with respect to locally acting compressive load and tensile load. In conventional Mg wrought material, in general the compressive yield stress is lower than the tensile yield stress, so there is the drawback that the strength of the structure against load is governed by the yield stress on the compression side, but the Mg alloy of the present invention overcomes this weak point.

Due to the above-mentioned isotropy of deformation, in the Mg alloy of the present invention, a high deformation ability is also exhibited with respect to both high speed deformation and impact loads. Therefore, the alloy can be used as a shock absorbing material or structural material for automobiles where impact loads act.

The invention claimed is:

1. An Mg alloy having a chemical composition consisting of Y: more than or equal to 0.6 at % and a balance of Mg and unavoidable impurities, having a microstructure with high Y regions with Y concentrations higher than an average Y concentration distributed at nanometer order sizes and intervals and having an average crystal grain size within the range satisfying the following formula 1:

$$-0.87c+1.10<\log d<1.14c+1.48 \quad \text{formula 1:}$$

where c: Y content (at %) and d: average recrystallized grain size (μm), wherein d is smaller or equal to 37.

2. The Mg alloy as set forth in claim 1, having an equiaxed grain structure and not having texture.

3. The Mg alloy as set forth in claim 1, having a Y content of more than 0.6 at % and an average recrystallized grain size within the range satisfying the following formula 2:

$$-0.55c+1.20<\log d<1.13c+0.93. \quad \text{formula 2:}$$

4. The Mg alloy as set forth in claim 1, having an average recrystallized grain size within the range satisfying the following formula 3:

$$\log d>-0.31c+0.92. \quad \text{formula 3:}$$

5. The Mg alloy as set forth in claim 4, having an average recrystallized grain size within the range satisfying the following formula 4:

$$-0.31c+1.22<\log d<-2.60c+6.14. \quad \text{formula 4:}$$

6. The Mg alloy as set forth in claim 1, wherein in the microstructure, high Y regions higher than the average Y concentration by 50% or more and low Y regions lower than the average Y concentration by 50% or more are alternately distributed by several nm order sizes and intervals.

7. A method of production of the Mg alloy as set forth in claim 1, comprising hot working an alloy having the chemical composition as set forth in claim 1, then isothermally heat treating the alloy to form the microstructure as set forth in claim 1.

* * * * *